US011268658B2

(12) United States Patent
Boni

(10) Patent No.: US 11,268,658 B2
(45) Date of Patent: Mar. 8, 2022

(54) HIGH EFFICIENCY LED LAMP

(71) Applicant: REDOX S.R.L., Reggio Emilia (IT)

(72) Inventor: Angelo Boni, Reggio Emilia (IT)

(73) Assignee: REDOX S.R.L., Reggio Emilia (IT)

( * ) Notice: Subject to any disclaimer, the term of this patent is extended or adjusted under 35 U.S.C. 154(b) by 146 days.

(21) Appl. No.: 16/623,876

(22) PCT Filed: Jun. 6, 2018

(86) PCT No.: PCT/IB2018/054039
§ 371 (c)(1),
(2) Date: Dec. 18, 2019

(87) PCT Pub. No.: WO2018/234913
PCT Pub. Date: Dec. 27, 2018

(65) Prior Publication Data

US 2021/0144830 A1 May 13, 2021

(30) Foreign Application Priority Data

Jun. 23, 2017 (IT) ..... 102017000070288

(51) Int. Cl.
*F21K 9/23* (2016.01)
*H05B 47/19* (2020.01)
(Continued)

(52) U.S. Cl.
CPC ..... *F21K 9/23* (2016.08); *F21K 9/65* (2016.08); *F21V 19/02* (2013.01); *F21V 23/003* (2013.01); *F21V 23/0435* (2013.01); *F21V 23/0492* (2013.01); *F21V 29/60* (2015.01); *F21V 29/70* (2015.01); *H05B 45/10* (2020.01);
(Continued)

(58) Field of Classification Search
CPC ... F21K 9/23; F21K 9/65; F21V 29/60; F21V 29/70; F21V 19/02; F21V 23/003; F21V 23/0435; F21V 23/0492; H05B 45/46; H05B 47/19; H05B 45/10; H05B 47/105; F21Y 2107/80; F21Y 2115/10
See application file for complete search history.

(56) References Cited

U.S. PATENT DOCUMENTS 8,072,123 B1 12/2011 Han
8,232,745 B2 7/2012 Chemel et al.
(Continued)

FOREIGN PATENT DOCUMENTS

CN 102362116 A 2/2012
CN 102639925 A 8/2012
(Continued)

*Primary Examiner* — Bao Q Truong
(74) *Attorney, Agent, or Firm* — Pearne & Gordon LLP

(57) ABSTRACT

A LED lamp, comprising: a base (3), provided with an attachment for connection to a source of electrical energy; a plurality of LED rows (4), each of which can be adjusted and controlled singly to switch on and off; a microprocessor (24), predisposed for controlling the LED rows (4); a communication module (25), connected to the microprocessor (24), predisposed for receiving and transmitting control signals of the lamp; a power supply (16), predisposed for electrically powering the LED rows (4); a detecting device (17), predisposed for detecting the position and the orientation in space of the lamp, connected to the microprocessor (24).

11 Claims, 8 Drawing Sheets

(51) Int. Cl.

| | |
|---|---|
| ***H05B 47/105*** | (2020.01) |
| ***F21V 29/60*** | (2015.01) |
| ***F21V 29/70*** | (2015.01) |
| ***F21K 9/65*** | (2016.01) |
| ***H05B 45/46*** | (2020.01) |
| ***H05B 45/10*** | (2020.01) |
| ***F21V 19/02*** | (2006.01) |
| ***F21V 23/00*** | (2015.01) |
| ***F21V 23/04*** | (2006.01) |
| *F21Y 107/80* | (2016.01) |
| *F21Y 115/10* | (2016.01) |

(52) U.S. Cl.

CPC ..... *H05B 45/46* (2020.01); *H05B 47/105* (2020.01); *H05B 47/19* (2020.01); *F21Y 2107/80* (2016.08); *F21Y 2115/10* (2016.08)

(56) References Cited

U.S. PATENT DOCUMENTS

| | | | |
|---|---|---|---|
| 8,668,354 | B2 | 3/2014 | Roth et al. |
| 9,239,136 | B1 | 1/2016 | Petersen et al. |
| 9,353,921 | B2 | 5/2016 | Bembridge et al. |
| 10,215,391 | B2 | 2/2019 | Newton et al. |
| 10,274,185 | B2 | 4/2019 | Kato et al. |
| 10,598,363 | B2 | 3/2020 | Newton et al. |
| 2009/0267540 | A1 | 10/2009 | Chemel et al. |
| 2010/0259931 | A1* | 10/2010 | Chemel ..... F21V 29/713 362/249.02 |
| 2011/0298351 | A1 | 12/2011 | Han |
| 2012/0091903 | A1 | 4/2012 | Bembridge et al. |
| 2012/0143383 | A1 | 6/2012 | Cooperrider et al. |
| 2012/0147604 | A1 | 6/2012 | Farmer |
| 2012/0281405 | A1 | 11/2012 | Roth et al. |
| 2016/0377278 | A1 | 12/2016 | Kato et al. |
| 2017/0175987 | A1 | 6/2017 | Newton et al. |

FOREIGN PATENT DOCUMENTS

| | | | |
|---|---|---|---|
| CN | 102918321 | A | 2/2013 |
| CN | 105934623 | A | 9/2016 |
| CN | 106062463 | A | 10/2016 |
| EP | 2233825 | A1 | 9/2010 |
| EP | 2636948 | A1 | 9/2013 |
| EP | 3133339 | A1 | 2/2017 |
| EP | 3361833 | A2 | 8/2018 |
| KR | 20130097403 | A | 9/2013 |
| WO | 2012161403 | A1 | 11/2012 |
| WO | 2016155521 | A1 | 10/2016 |

* cited by examiner

16

HIGH EFFICIENCY LED LAMP

High-efficiency lighting lamps, mainly constituted by white LEDs, are becoming more and more frequent, and are even replacing (fluorescent) gas-discharge lamps because of their greater efficiency and the long working life of LEDs. Although they are more expensive than other types of lamp, the energy efficiency is about double that of fluorescent lamps, and they last from three to four times longer. With these parameters of efficiency and working life, it is clear that the higher cost is well-absorbed by the savings made during the working lives of the LED lamps. The aim of the present invention is to further improve the performance of attachment lamps of the Edison type (E27, E40 for example) and all the lamps with a rotational-type attachment system, in particular screw attachments, which does not enable a single positioning of the lamp once screwed in.

The prime need is to dose the light emitted, by way of example in road lighting, following the direction of the road. In this case a greater degree of lighting is required in the direction of travel and a smaller or no illumination at the sides of the lighting body. This side lighting is indeed not useful for the illumination of the road surface, and can even be damaging, in cases in which it strikes houses at the side of the road, for those dwelling there and who are thus forced to keep shutters closed to obtain full night time darkness.

An example of a LED lamp of known type is illustrated in FIGS. 1 and 2. The lamp comprises a plurality of LED rows (4), mounted on an insulating base (3) supporting them. The lamp is provided with an Edison type screw-connector of the Edison type (2) for attachment to the existing plant, in order to be substitutable for incandescent or fluorescent lamps, with no modification to the pre-existing structure.

The lamp is further provided with slots (6) that together with further slots (5) present on the insulating base (3) enable circulation of cooling air, which can be by natural convection or by fan forced convection.

As illustrated in FIG. 2, the lamp is further provided with heatsinks (4*a*) which can be single for each LED row (4) or joined in a single heatsink.

The heatsinks comprise, for example, one or more finned bars, associated to the LED rows (4).

The LED rows (4) can be lit all together, as can the upper LEDs (24) present in the upper part of the lamp. The simultaneous switching on of all the LEDs sends light in all directions, both where it is needed and in directions in which it is uselessly dispersed.

Each LED row might be lit separately from the others. This would however not enable correctly selecting the LED rows facing in the desired direction, as the lamp is rotated into an undefined screwed position. The selected switching on of the LED rows should therefore be carried out after the lamp has been screwed in. This operation would be rather awkward and laborious, considering that hundreds of lamps can be set up in succession along a road. Further, the upper LEDs (24) would be activated only if the lamp is facing downwards, while it would be useless with the lamp orientated upwards.

The aim of the present invention is the automation of the adjusting process of the zones illuminated by the lamp, independently of the orientation thereof, and by the possible substitution of the lamp with another. The requested lighting mode can be transferred from lamp to lamp automatically, so as to program a plurality of street lamp almost instantaneously. Said programming can also involve other auxiliary functions, which will be equally transferred automatically onto each lamp.

Characteristics and advantages of the present invention will more fully emerge from the following detailed description of an embodiment of the invention, as illustrated in a non-limiting example in the accompanying figures, in which.

Figure 1:
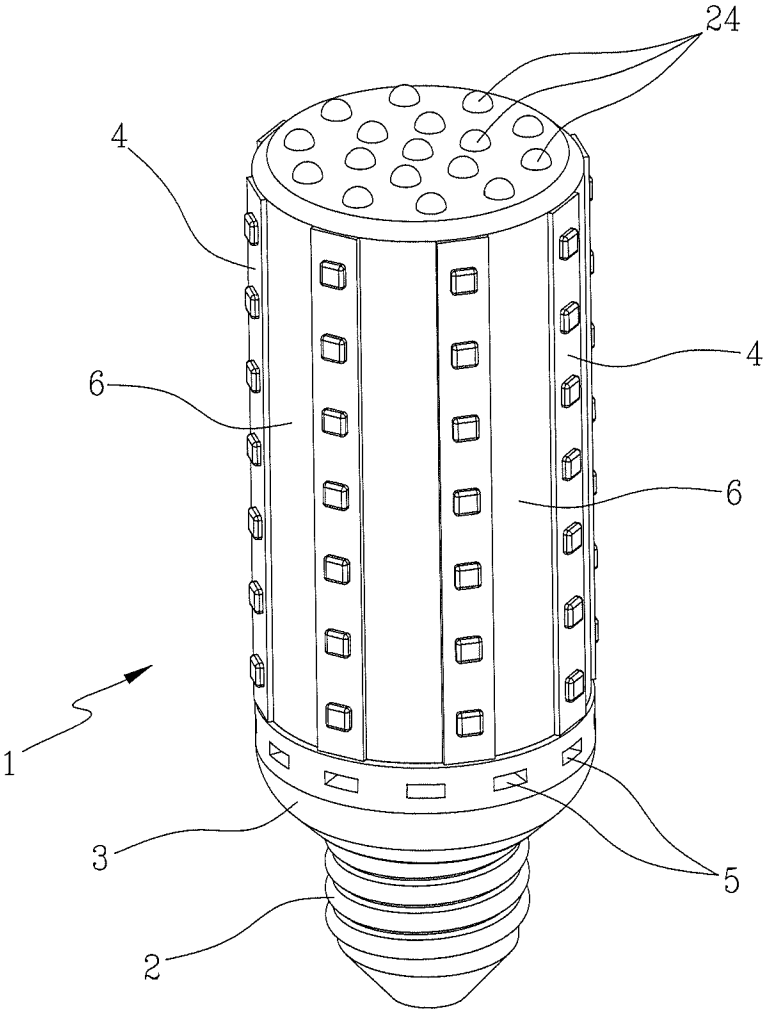
FIG. 1 is a schematic illustration of a first view of a LED lamp of known type.
Figure 5:
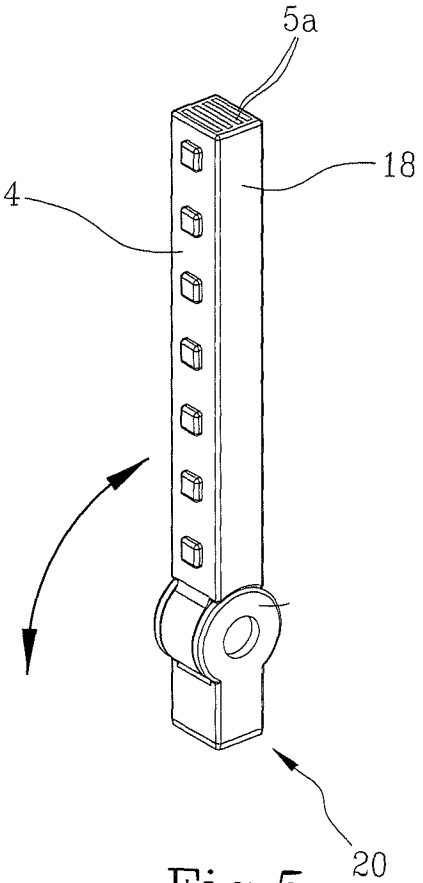
Figure 3A:
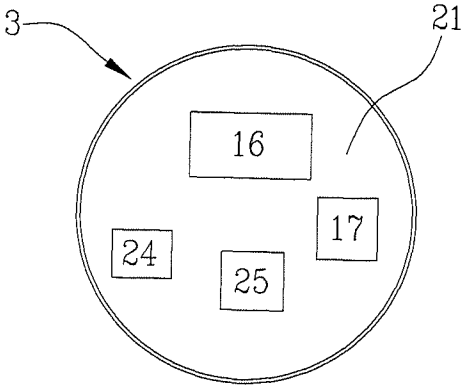
Figure 3:
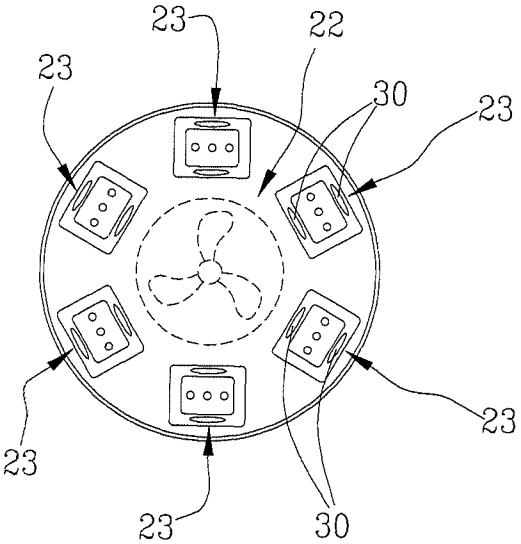
Figure 4:
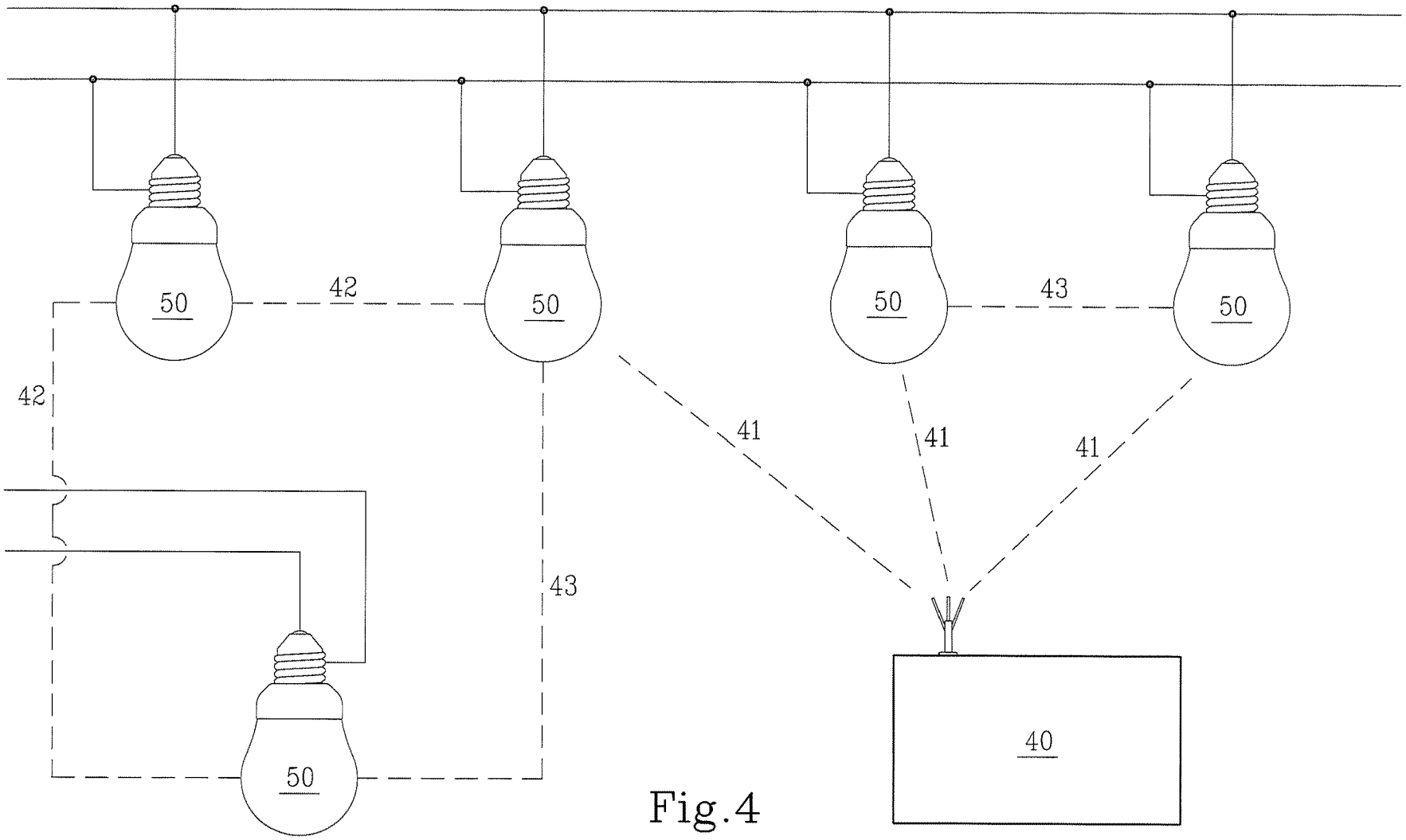
Figure 6A:
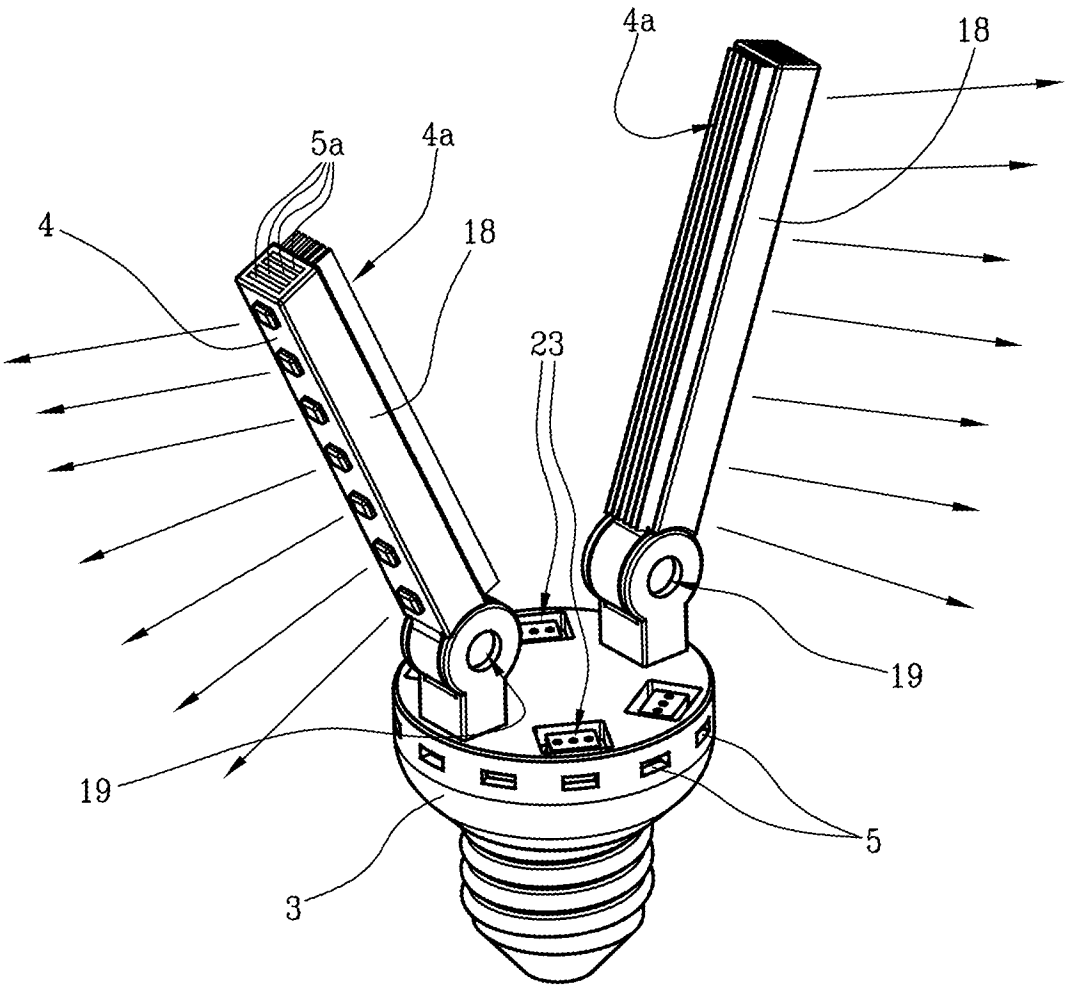
Figure 6B:
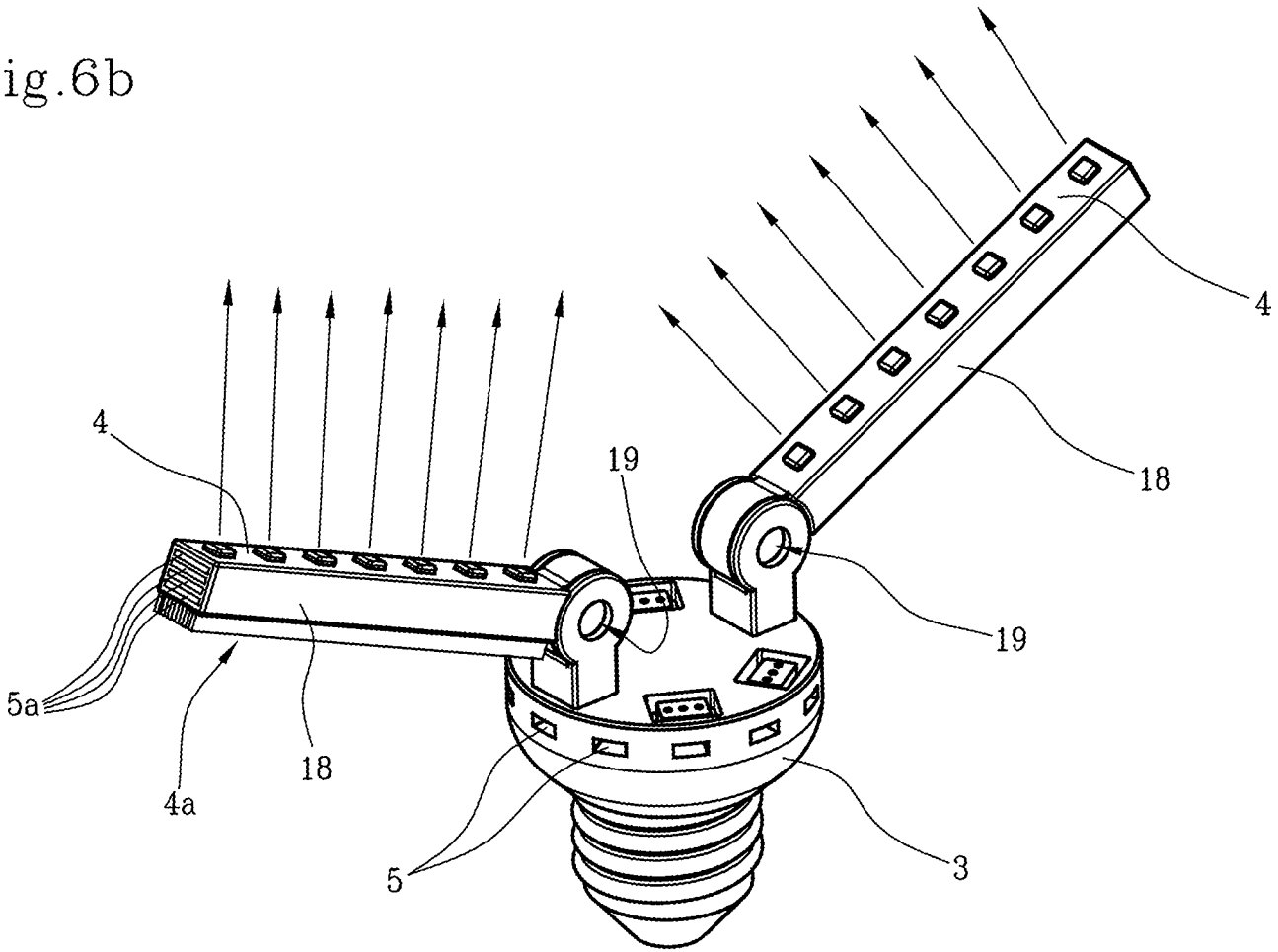
Figure 7A:
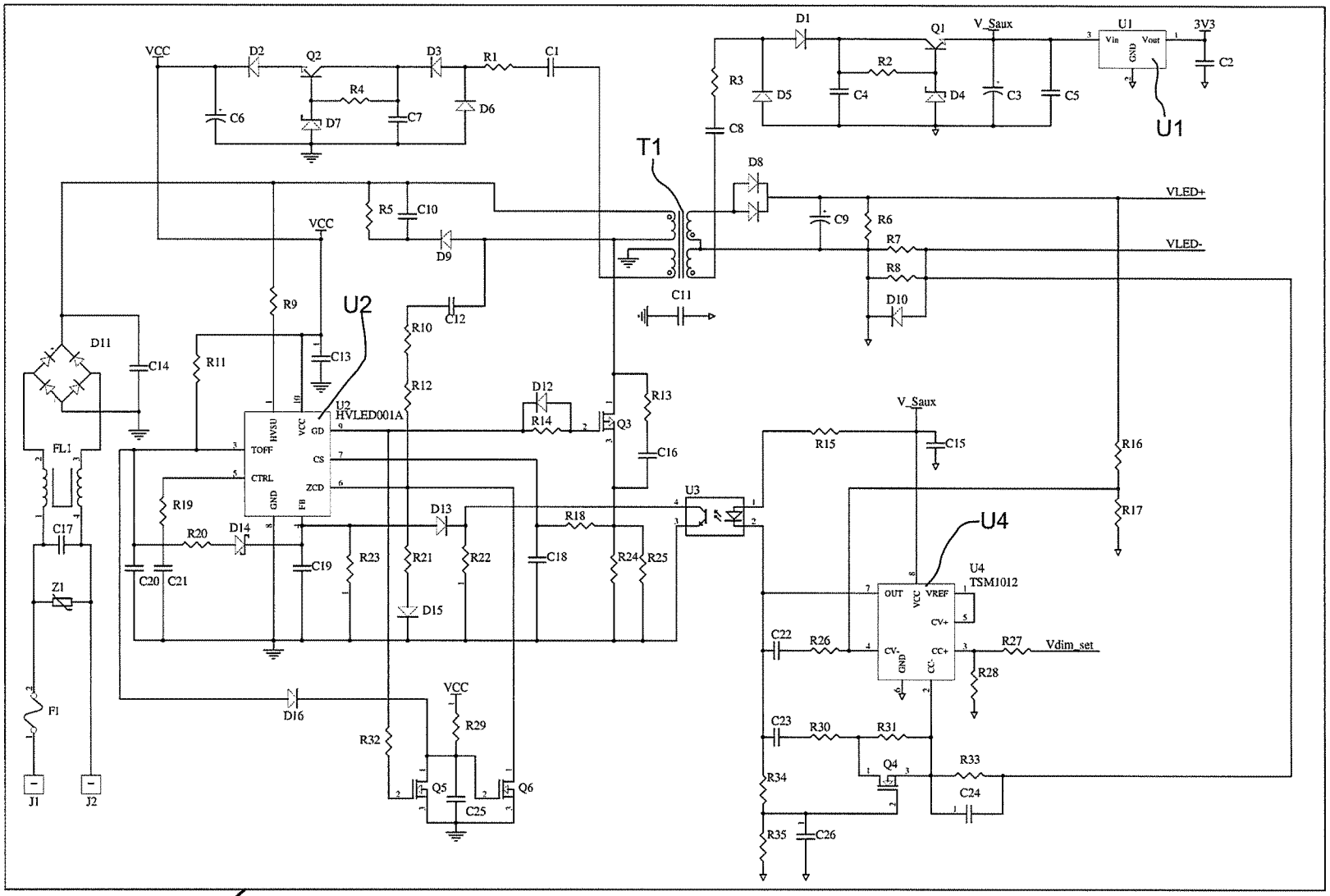
Figure 7B:
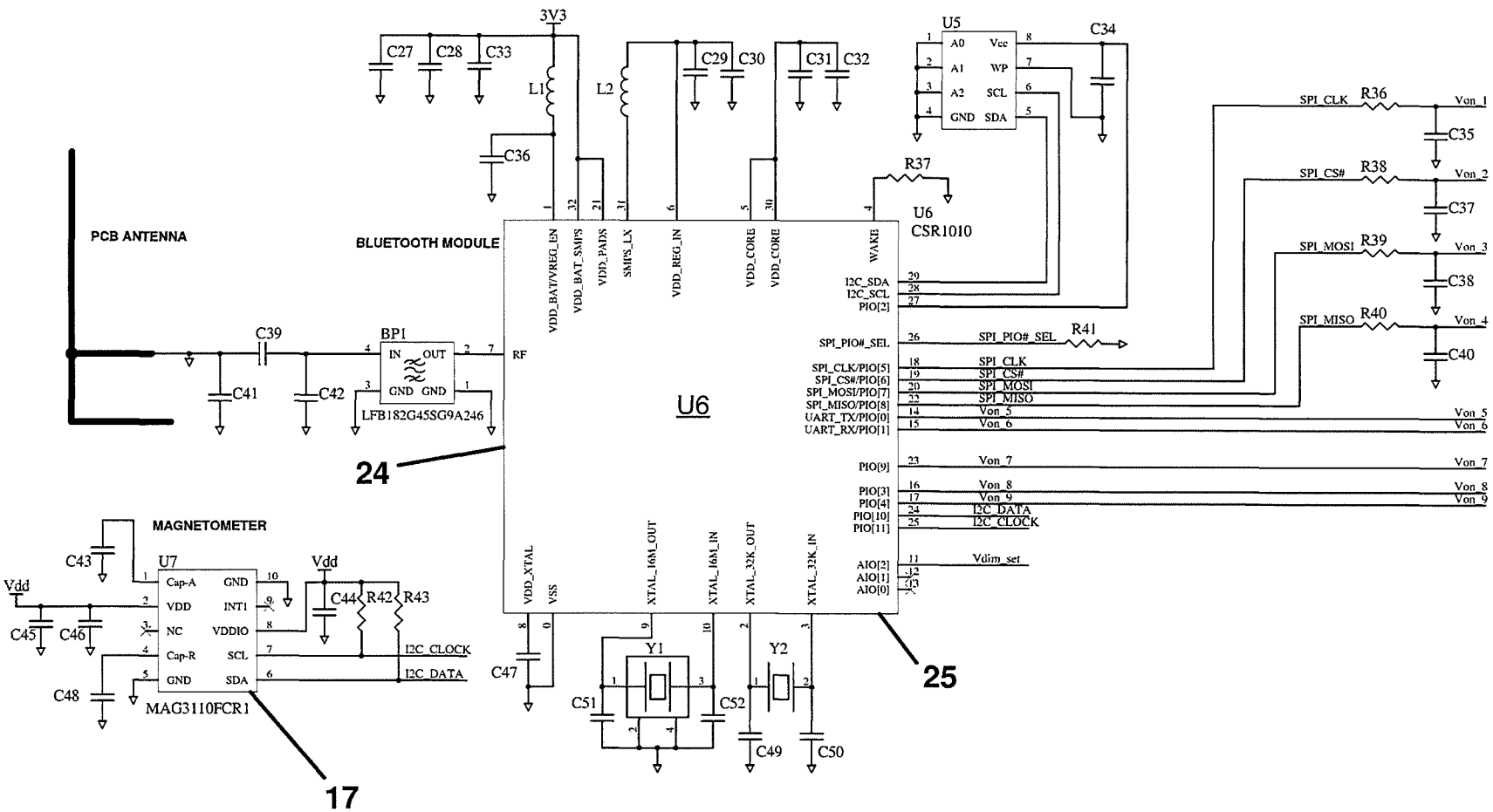
Figure 7C:
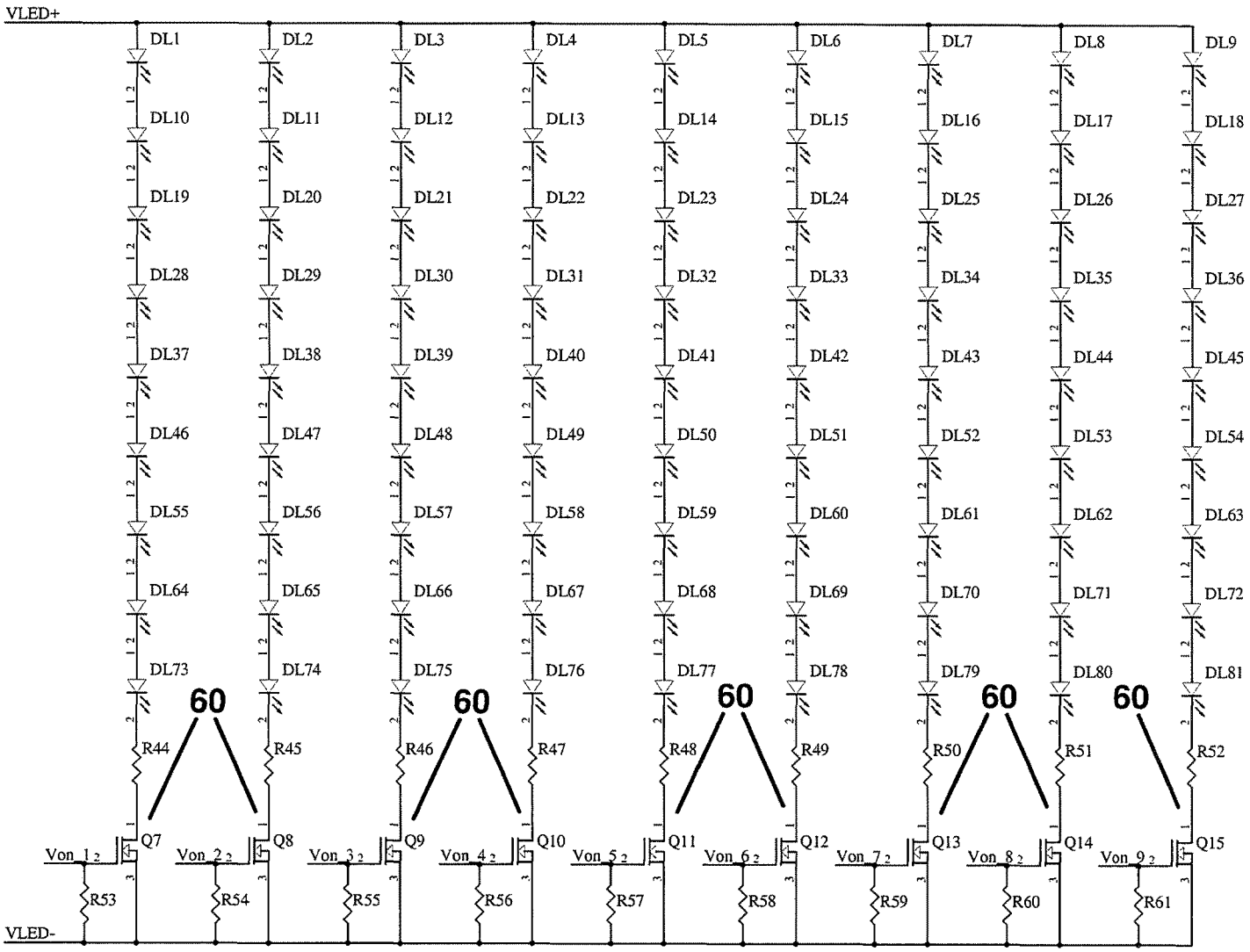

FIG. 3 schematically illustrates the base of the lamp of FIG. 1 in a view from above;

FIG. 3A illustrates some electronic components contained internally of the base of the lamp;

FIG. 4 is a diagram of a plant which comprises a plurality of lamps according to the present invention;

FIG. 5 shows a component of the lamp according to the present invention;

FIGS. 6A and 6B show a lamp according to the present invention in two operating configurations;

FIGS. 7A, 7B, 7C are respective electronic diagrams for the supply and control of a lamp according to the present invention.

The lamp of the present invention comprises a plurality of LEDs, distributed in various rows (4) associated to a base (3) of the lamp.

The rows (4) of LEDs can be switched on and off singly, by means of a semiconductor electronic switch (60) (Mosfets, transistors, etc.), located in series to each LED row (4). As illustrated in FIG. 7, each switch (60) can be controlled by a microprocessor (24) located for example in the base (3) of the lamp. The microprocessor (24) can be integrated, for example, in a printed circuit (21), arranged in the base (3).

A power supply (16) is predisposed to supply the electrical power to the LEDs, to the microprocessor (24) and to the other elements present on the printed circuit (21).

The lamp can advantageously be provided with an integrated communication circuit (25), predisposed to remotely communicate with a programming module and with the other lamps present in the lighting system. For example, the integrated circuit (25) can be Bluetooth technology or, in general, wireless. The programming module might be a true and proper programming station, or it might be constituted by a smartphone or a portable programming device.

The lamp according to the present invention further comprises a detecting device (17), predisposed for detecting the position and the orientation in space of the lamp. The detecting device (17) comprises for example an accelerometer or a magnetometer (17). The detecting device (17) can be made using MEMS technology.

The detecting device (17) is connected to the microprocessor (24) and sends thereto a piece of information corresponding to the position and the orientation in space of the lamp.

The microprocessor (24) is predisposed for controlling the switching on of one or more LED rows (4) as a function of the piece of information received from the detecting device (17). For this purpose, the microprocessor (24) can be provided with an algorithm (for example in the form of firmware), structured for selectively controlling the switching on of one or more LED rows (4) as a function of the piece of information received from the detecting device (17).

In substance, the detecting device (17) enables localising the lamp in space, i.e. it enables establishing if it is directed upwards or downwards and how it is geographically orientated (in relation to the cardinal points). It is therefore clear that independently of the mounting position of the lamp, it is possible to define the spatial location thereof with precision. By way of example, if the road is orientated in the North-South direction and the lamp is in the centre of the road, it is possible to control the lamp, using the microprocessor (24), to light up the LED rows (4) facing northwards, to the North-East, North-West, South-East, South-West, South, i.e. with the LED rows (4) facing towards the road. This programming is valid for all the lamps located on the road as long as it is straight, and can be transmitted to all the lamps which have the same positioning with respect to the road. The programming control can be transmitted by the programming module or by a portable control device of the type described in the foregoing. If the road to be lit is characterised by bends and curves, use of a calculating algorithm based on maps can be made, to program each lamp automatically, due to the presence of the detecting device (17) which is able to indicate the orientation of each lamp. The use of a Bluetooth transmission protocol for programming the lamps consists in using the known safety algorithms to create a secure and single connection among the lamps and the control device.

The lamp according to the present invention can be advantageously used in all cases in which an asymmetrical lighting is necessary, for example in parks, gardens, courtyards, porticoes, crossroads. The possibility of subdividing the lighting into contiguous sectors, for example eight segments of a circle, in addition to an upper or lower sector (according to the orientation), makes the lamp extremely flexible and adaptable to the various needs, enabling a significant energy saving. By using a smaller attachment of the Edison type, such as for example the E27, very widely used in dwellings, offices, corridors, apartment blocks, etc., the same technology illustrated above can be used in smaller environments to like advantage.

The use of the lamp of the present invention is possible without any need to change the existing plants and structure, simply by screwing in the lamps of the invention in place of the old lamps.

As well as the above-described energy savings, based on the switching off of the LED rows that are not required, it is possible to actuate a series of auxiliary functions without increasing the cost of the hardware structure of the lamp, thanks to the presence of the microprocessor (24).

By way of example the luminosity can be reduced over the nocturnal hours, so as to actuate a greater energy saving when the roads or places, normally illuminated, can be lit to a lesser or partial extent. For example, in a park, after a certain time the light facing towards benches and play spaces can be switched off, while a good degree of lighting can be maintained on the lanes and paths, to guarantee a good degree of security to those people having to cross the park at a late time.

With the communication circuit (25) provided on each lamp, each lamp can receive in communication the instructions necessary for obtaining the lighting conditions required during functioning, for example during the night-time hours lighting.

The lighting plant of the present invention enables realising a lighting plant comprising a plurality of lamps (50), illustrated schematically in FIG. 4.

The plant can be provided with a programming module (40), predisposed to communicate with the lamps of the plant, which can be arranged for example along a road, in a park or elsewhere.

Preferably, though not necessarily, the lamps are provided with an integrated communication circuit (25) using Bluetooth technology. As is known this technology enables the various lamps to communicate with one another, forming a network which comprises the connections between the programming module (40) and the various lamps (50). These connections can be direct (41) or indirect (42), i.e. established via the other lamps (50), in order to enable reaching the lamps beyond the direct reach of the programming module (40). The use of a Bluetooth connection further enables defining an alternative connection (43) in a case of a fault in one of more lamps (50). In this way, the programming module (40) can be located at any point of the plant.

Further, the control module (40) can be connected to other networks available in the zone, for example WI-FI, WLAN, Ethernet urban networks, etc.

The information or instructions that can be sent to the various lamps (50) comprise, for example:

switching on/switching off time;

luminous intensity of the various zones;

total luminous intensity of the lamp;

diagnostics of the lamp (correct functioning of the various zones, temperature, working life, etc.).

The existing lighting networks enable the sending of instructions to the various lamps, using the conveyed waves or a programming via a series of slow pulses (about one per second), sent on the supply voltage of the lamps.

In the lamps of the present invention, which enable using BT technology or other similar technologies, it is possible to send the various information or instructions in radio frequency, and with protocols predisposed to enable connection of the lamps on the network, subdividing them, for example, into defined groups that can be managed in the most effective way.

In particular, the use of the microprocessor (24) and the power supply (16) enables maintaining the communication network constantly active between the lamps and the programming module (40). For this purpose it is sufficient to maintain the power supply (16) active, switching off the LEDs at all times when lighting is not required, so as to limit energy consumption to a minimum.

The possibility of maintaining the communication network between the lamps and the programming module (40) enables implementing the following functions in the lighting network.

An anti-theft function, which enables detecting an eventual interruption in the communication network, as a possible consequence of a cut in the supply cables, enabling the launching of an alarm signal.

A localisation and aid function, in which the network of lamps can function as a receiver for search messages or calls for help, for example by elderly persons. The messages can be sent via remote devices, for example "tags" of known type, which can be easily located within the area covered by the network of lamps.

A direct control function of the single lamps. For example, extra illumination can be requested from the nearby street lamps on a bench, in a park. The request can be sent via a remote device, for example a smartphone, using a special application. In the absence a request of this type, the lamps can be maintained at a lower lighting level to enable a greater saving of energy.

A diagnostic function, which enables verifying the status of the lamps and radio signalling of broken and/or poorly-efficient lamps, for example through voltage, current and/or temperature data for each LED row.

A further advantage of the lamp of the present invention is given by the possibility of orientating the lighting produced in an effective way.

In known-type lamps the orientation of the light emitted is provided by an external reflector which concentrates the light where necessary. The reflector tends to become dirty and less efficient with the passage of time.

Further, in order to be effective in concentrating the light, the reflector must have a diameter of at least three times that of the lamp, and is therefore of significant dimensions.

The lamp of the present invention can be provided with LED rows (4) associated to a first support (18), for example in the form of a bar. This first support (18), by means of a swivel joint (19), is associated to a connector (20) that is structured to connect to the base (3) of the lamp, for this purpose equipped with connectors (23) for the electric power supply to the LEDs. The use of the swivel joint (19) enables inclining the first support (18) with respect to the connector (20), so as to direct the light towards a desired direction. For example, if the base (3) is facing downwards, the supports (18) can be inclined as shown in FIG. 6B, to direct the light downwards. If the base (3) is instead facing downwards, the supports (18) can be inclined as shown in FIG. 6A, to direct the light downwards.

Figure 2:
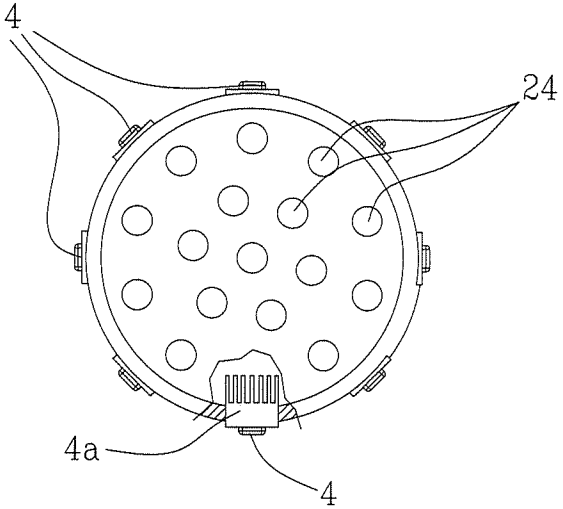
FIG. 2 illustrates the lamp of FIG. 1 in a view from above.

Each support (18) is preferably but not necessarily provided with a heatsink (4*a*), of the type illustrated in FIG. 2. The connectors (23) of the base (3) can be provided with slots (30) for passage of an air flow for cooling the heatsink (14) and/or the LED rows (4). The air flow might be forced, i.e. obtained by a fan (22) housed in the base (3) of the lamp. The fan (22) is configured to push the air through the slots (30) of the connectors (23). The air is then channelled through a part of the connector (20) associated to the first support (18). The air flow can enter through the slots (5) on the base (3) of the lamp, and exit from each support (18) through slots (5*a*) arranged at the end of each first support (18).

Alternatively the first support (18) can be open at the end, so that the air flow is free to exit after having struck the heatsink (4*a*).

The LEDs are powered by direct current. Consequently the connection made between the connectors (20, 23) must also have the same supply polarity. For this purpose, the connectors (20, 23) are provided with three power supply poles aligned to one another, of which a central pole and two lateral poles. The two lateral poles have an identical polarity that is opposite to the polarity of the central pole. For example, the central pole is negative, and the two lateral poles have a positive polarity. In this way, independently of the insertion direction of the connector (20) of the LEDs in the connector (23) of the base (3), the LED row receives the correct polarity. This enables positioning each LED row (4) in two symmetrical positions with respect to a plane containing the three poles. In this way, independently of the upwards or downwards orientation of the base (3), the supports (18) can be inclined so as to direct the light in the desired direction.

FIGS. 7A, 7B, 7C highlight the preferred embodiment of the invention, as it is realised, in particular FIG. 7A illustrates the diagram of the power supply (16) in a typical realisation thereof, where the integrated circuit U2 functions as a switchable power supply of the Flyback type, the transformer T1 lowers the network voltage to values compatible with LED rows (4). The circuit U4 controlled by the processor (25), regulates the luminosity of the LEDs, while the supply circuit U1 powers the auxiliary circuits. FIG. 7B illustrates the processor (24) and the BT communication circuit (25), which in this case are made in a single integrated circuit U6 model CSR1010. The magnetometer-accelerometer (17) is connected to the processor (24) and detects the position data of the lamp. FIG. 7C denotes the nine LED rows (4), controlled by the Mosfets (60), able to manage the switching on and the switching off of each single LED row. The command of the control elements (60) is via the processor (25).

The invention claimed is:

1. A LED lamp, comprising:

a base (3), provided with an attachment for connection to a source of electrical energy;

a plurality of LED rows (4), each of which can be adjusted and controlled singly to switch on and off;

comprising:

a microprocessor (24), predisposed for controlling the LED rows (4);

a communication module (25), connected to the microprocessor (24), predisposed for receiving and transmitting control signals of the lamp;

a power supply (16), predisposed for electrically powering the LED rows (4);

wherein the power supply comprises a detecting device (17), predisposed for detecting the position and the orientation in space of the lamp, connected to the microprocessor (24) for transmitting a piece of information (24) corresponding to the position and the orientation in space of the lamp to the microprocessor;

the microprocessor (24) is predisposed for selectively controlling the switching on of one or more LED rows (4) as a function of the piece of information received from the detecting device (17).

2. The lamp according to claim 1, wherein the communication module (25) is predisposed for receiving and transmitting one or more from among the following control signals of the lamp:

switching on one or more LED rows (4);

switching off one or more LED rows (4);

adjusting the luminosity emitted by one or more LED rows (4).

3. The lamp according to claim 1, wherein the communication module (25) is predisposed for transmitting diagnostics relative to the operating status of the lamp.

4. The lamp according to claim 1, wherein the microprocessor (24) is predisposed for controlling the switching on of some LED rows (4) and the switching off of other LED rows (4) in relation to the position of the lamp detected by the detecting device (17).

5. The lamp according to claim 1, wherein the communication module (25) is predisposed for detecting the signals emitted by one or more emitting devices present in the receiving area of the communication module (25), and for transmitting a signal indicating the position of the emitting devices and/or a signal indicating the contents of the signal received by the emitting devices.

6. The lamp according to claim 1, wherein each LED row (4) is associated to a first support (18), in turn associated to a connector (20) by means of a swivel joint (19) which enables varying the inclination of the first support (18) with respect to the connector (20).

7. The lamp according to claim 6, wherein the first support (18) comprises a heatsink (14), and wherein the base (3) is provided with attachments (23), each of which is predisposed for enabling connection of a connector (20) and is provided with at least a slot (30) which enables passage of an air flow for cooling the LEDs (4) and the heatsink (4*a*) associated to the connector (20).

8. The lamp according to claim 6, wherein:

each connector (20) comprises three power supply poles aligned to one another, of which a central pole and two lateral poles;

the base (3) is provided with attachments (23), each of which is predisposed for enabling connection of a connector (20) and is provided with three power supply poles aligned to one another, of which a central pole and two lateral poles;

the two lateral poles have an identical polarity that is opposite to the polarity of the central pole.

9. A lighting plant, comprising:

a plurality of lamps (50) according to claim 1, wherein the communication module (25) is able to send to the communication modules (25) of other lamps (50), and is able to receive, from the communication modules (25) of the other lamps (50), information signals and control signals;

a programming module (40) predisposed for sending control instructions to the communication modules (25) of the lamps (50) and for receiving information signals from the communication modules of the lamps (50).

10. The lighting plant according to claim 9, wherein the control signals sent by the programming module (40) comprise one or more from among the following controls:

switching on one or more LED rows (4);

switching off one or more LED rows (4);

adjusting the luminosity emitted by one or more LED rows (4).

11. The lighting plant according to claim 9, wherein the information signals sent by each communication module (25) comprise one or more from among following items of information:

interruption of electrical power supply to a respective lamp (50);

request for a variation in intensity of the light emitted by a remote device;

presence of a remote device;

contents of a signal emitted by a remote device;

operating status of the respective lamp (50).

* * * * *